US006109557A

United States Patent [19]

Kremer

[11] Patent Number: 6,109,557

[45] Date of Patent: Aug. 29, 2000

[54] WINDING DEVICE FOR THREADS FROM CREELS

[75] Inventor: Hubert Kremer, Grefrath, Germany

[73] Assignee: Sucker-Muller-Hacoba GmbH & Co., Monchengladbach, Germany

[21] Appl. No.: 09/180,378

[22] PCT Filed: May 6, 1997

[86] PCT No.: PCT/EP97/02307

§ 371 Date: Nov. 5, 1998

§ 102(e) Date: Nov. 5, 1998

[87] PCT Pub. No.: WO97/42364

PCT Pub. Date: Nov. 13, 1997

[30] Foreign Application Priority Data

May 6, 1996 [DE] Germany ..... 296 08 169 U

[51] Int. Cl.[7] ..... B65H 23/16

[52] U.S. Cl. ..... 242/419.1; 242/419.7; 242/131.1; 28/194

[58] Field of Search ..... 242/419.1, 419.7, 242/417, 417.3, 131.1; 28/185, 194, 196, 197

[56] References Cited

U.S. PATENT DOCUMENTS

| | | | |
|---|---|---|---|
| 2,542,097 | 2/1951 | Shaffer et al. | 242/131.1 |
| 3,072,998 | 1/1963 | Bijl | 28/194 |
| 4,598,184 | 7/1986 | Price et al. | 242/131.1 X |
| 4,646,989 | 3/1987 | VAn Wilson | 242/131.1 |
| 4,819,310 | 4/1989 | Beerli et al. | 28/185 |
| 4,890,368 | 1/1990 | Schewe | 28/185 |
| 5,027,484 | 7/1991 | Baba | 28/185 |
| 5,752,549 | 5/1998 | Derudder et al. | 242/131.1 X |

FOREIGN PATENT DOCUMENTS

| | | | |
|---|---|---|---|
| 3436714 | 4/1986 | Germany | 242/131.1 |
| 0319477 | of 1989 | Germany . | |
| 4002545 | of 1990 | Germany . | |
| 9306680 | of 1993 | Germany . | |
| 45-18738 | 6/1970 | Japan | 242/131.1 |
| 61-275436 | of 1986 | Japan . | |
| 05222638 | of 1993 | Japan . | |
| 648610 | of 1985 | Switzerland . | |
| 405158 | 2/1934 | United Kingdom | 242/131 |
| 1449351 | 9/1976 | United Kingdom . | |

OTHER PUBLICATIONS

1236 Melliand Textilberichte, 73 (1992) Apr., No. 4, Heidelberg, DE.

*Primary Examiner*—Donald P. Walsh
*Assistant Examiner*—Minh-Chau Pham
*Attorney, Agent, or Firm*—Pandiscio & Pandiscio

[57] ABSTRACT

Winding device for threads from V-creels, from the bobbins of which the threads are drawn off via pre-looping bars and through a comb, and wound on a winding shaft of the winding device, where the pre-looping bars near the winding device have more threads looped around them and those farther away have fewer, and their degree of looping is centrally adjustable. At least one measuring device is placed beyond the comb in the direction of travel of the threads to determine tension in the threads and central adjustment of the pre-looping bars is controlled in relation to the result of measurement. To permit automatic resetting of the pre-looping bars independently of the material and the running speed of the threads in winding devices of different kinds, the winding device is constructed such that the pre-looping bars are divided at least on one side of a creel into successive functional groups to at least one of which is allocated a measuring device to determine the tension in threads of this group. A central adjustment of at least one group can be controlled in accordance with the result of measurement.

11 Claims, 3 Drawing Sheets

WINDING DEVICE FOR THREADS FROM CREELS

BACKGROUND OF THE INVENTION

This invention relates to a winding device for threads from V-creels, from the bobbins of which the threads are drawn off via pre-looping bars and through a comb, and are wound up on a winding shaft of the winding device, with the pre-looping bars being wound with more threads near the winding device and fewer threads at a distance from it, and with their degree of looping being centrally adjustable, with at least one measuring device being located beyond the comb in the running direction of the threads for determining the thread tension in threads, and with the central adjustment of the pre-looping bars being controllable according to the result of measurement.

The winding device pulls the threads off of bobbins that are set on bobbin spindles of bobbin stations of the bobbin creel. They ordinarily have to be braked to produce the thread tension or thread tensile force necessary for proper winding. However, the thread running speed can become so great that the braking, of the threads when being taken off of the bobbins is no longer necessary. Above all, the atmospheric frictional resistance of the thread can become so great that additional braking is unnecessary. This is especially true for V-creels. The thread tension produced by the atmospheric frictional resistance of the thread, however, depends on the length of the thread between the bobbin station and the winding device. In the case of long creels this has the result that the threads that come from the end of the creel have greater thread tension on the winding device than the threads that come from the beginning of the creel. To compensate for these differing thread tensions, the pre-looping bars are used so that there is stronger looping of the bars by the threads at the beginning of the creel but weaker looping at the end of the creel. Accordingly, the thread tensions are affected differently. In particular, the thread tensions of the threads running off from the beginning of the creel are increased so that they are equal in all of the threads running to the winding device.

Controlling of the thread tensions of the threads results from their friction on the pre-looping bars. The friction of the threads rubbing approximately tangentially on the pre-looping bars depends on their material and on the running speed of the threads. Even using the same material with different thickness provides different thread tensions. Readjustment of the pre-looping bars is then necessary to achieve matching. The more the threads differ in material and speed, the more difficult such matching becomes. Automatic readjustment is not possible since the entire pre-looping bar unit can be adjusted only as a whole.

There is a need for adjustment also with different winding devices. This applies to all installations in which the threads to be rewound are drawn off with thread braking by a thread clamp for each, that clamps the threads in case of shutdown or thread breakage. There is also a need for adjustment when several winding shafts are to be wound from one set of bobbins, since additional thread tensions result from the decreasing bobbin diameters and the increased rotation of the thread around the bobbin resulting from this. From the winding of one shaft to the winding of the next shaft, a thread tension increase occurs that has to be compensated for, so that the wound diameter of the second shaft does not become smaller than that of the first.

A winding device with the features mentioned at the outset is disclosed by DE 9 306 680 U1. It is possible with the braking bars to control the running resistance of the threads by adjusting these rods relative to one another to vary the looping. Such adjustment, however, cannot occur predominantly automatically because the overall adjustment and/or the central adjustment of the pre-looping bars cannot take into consideration the fact that the thread tensions change differently from the end of the creel to the beginning of the creel depending on the material and thread running speed. The same also applies to the winding device of DE 40 02 545 A1, which relates to a winding device with the initially mentioned features and in which a control unit serves to maintain a constant tension of running threads from the beginning to the end of the warping frame operation.

SUMMARY OF THE INVENTION

The task underlying the invention, therefore, is to improve a winding device with the initially mentioned features so that automatic readjustment of the pre-looping bars is made possible, independently of the material and the thread running speed of the thread in winding devices of differing types.

This problem is solved by providing that the pre-looping bars of at least one side of a creel are divided into successively located functional groups, to at least one of which is allocated a measuring device to determine thread tension in threads of this group, and that a central adjustment of at least one group is controllable according to the result of measurement.

It is important for the invention that a measurement is performed on a winding device for threads from V-creels. This measurement to determine thread tension in threads permits the pre-looping bars to be readjusted according to the result of measurement. Consequently, the preselected thread tensions and/or the preselected thread tension ranges are controlled and thus maintained, and therefore including also in particular during the winding operation of the V-creel.

It is also important for the invention for pre-looping bars to be combined into functional groups. Thread tension can be determined for each group by using a measuring device, and can then be controlled by groups. Consequently it is possible to adjust one group to a different extent than another group. Adjustment can be automated so that braking can be applied differently by thread groups. Consequently the friction of the threads on the pre-looping bars can be controlled correspondingly, so that equal or at least approximately equal thread tensions can be achieved in the groups of threads. The thread tensions of the threads coming from the beginning of the creel can be better matched to the thread tensions of the threads coming from the end of the creel when their materials and running speeds are changed. Automatic detection of thread tensions is made possible, including also a shutdown of the winding process in case of emergency. Control by functional groups also makes it possible in particular to achieve matching during the winding process, not just from wound lot to wound lot.

A suitable structural design of the winding device is achieved when the measuring device is placed beyond a thread-collecting bar that is tangent to threads fed in from the creel, in the running direction of the threads. The thread-collecting bar brings all of the infed threads, or some of them, to a predetermined level, which contributes to facilitating the measurement of the thread tensions of several threads. In particular, the structural expenditure for the design of the measuring device is lower.

The winding device can be designed so that the thread-collecting bar is vertically adjustable and supports one or more measuring devices. The adjustability of the thread-collecting bar makes it possible to adapt to the particular thread infeed conditions, particularly with the measuring devices also being moved correspondingly. Consequently, individual adjustments of the measuring devices are not necessary, including in particular mounts for the measuring devices independent of the thread-collecting bar. The measurement range of the measuring device can be taken into account by the adjustment of the thread-collecting bar.

The winding device can be operated with various measuring devices. However, a design is appropriate in which the measuring device has a pressure-measuring strip supporting a number of threads that has a dip blade at each end that dips into the band of threads. Especially in combination with an adjustable thread-collecting bar, suitable detection of some of the threads of the entire band of threads is produced. The measuring device provides a measurement corresponding to this portion for further control.

The winding device can be designed so that a measuring device makes tension measurements in at least a portion of the threads. Averaging is possible that does not show errors that occur with individual measurement on a thread. On the other hand, the engineering expense for detecting all of the threads is avoided.

Control can be accomplished in various ways, meeting the control needs in each case. It is advantageous to design the winding device so that the central adjustment is controllable toward equality of the measured data from all of the measuring devices, and/or toward predetermined thread tensions. Control toward equality of the measured data provides for the relative consideration of differing thread tensions without considering their magnitudes. This is sufficient in a number of applications. However, there are also threads especially sensitive to thread tensions for which it is necessary not only to equalize the thread tensions between the particular groups qualitatively, but also quantitatively, so that control is therefore carried out toward predetermined thread tensions, e.g. with consideration of given maximum thread tensions.

The extent of subdivision of the pre-looping bars into functional groups is governed by the accuracy needs. It is possible to form a number of successively positioned functional groups. A simple design of the winding device is achieved when all of the pre-looping bars of one side of the creel are divided into two successively positioned functional groups. In any case, serious differences in thread tensions can be compensated for by such a winding device design at low structural cost.

Particularly low structural cost is achieved when only the group of pre-looping bars that is associated with the measuring device is centrally adjustable. The other functional groups can be left uncontrolled, for example the functional group with the higher thread tensions, i.e. the functional group of pre-looping bars for the threads that come from the end of the creel.

A substantially greater scope of function with regard to automatic adjustment is achieved, however, when a measuring device is allocated to each functional group.

In particular, faster and automatic matching to different materials of threads to be wound up can then be accomplished.

BRIEF DESCRIPTION OF THE DRAWINGS

The invention will be described with reference to examples of embodiment illustrated in the drawing. The drawing shows.

DETAILED DESCRIPTION OF THE INVENTION

Figure 1:
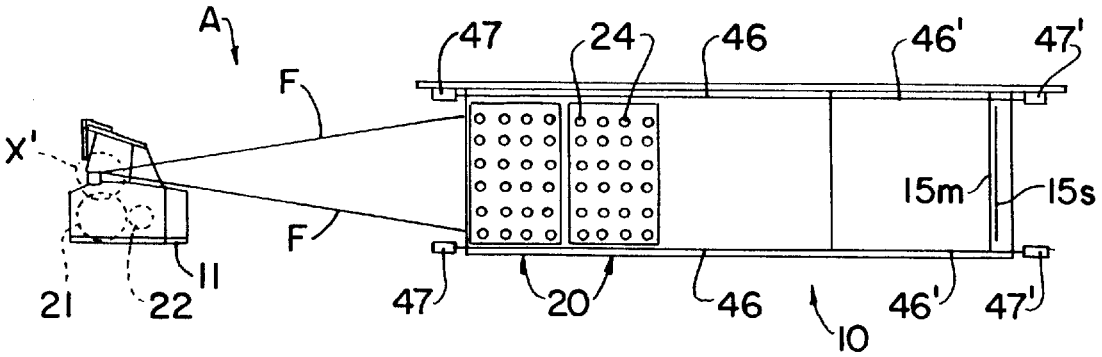
FIG. 1: a schematic side view of a bobbin creel with a thread-pulloff winding device.
Figure 2:
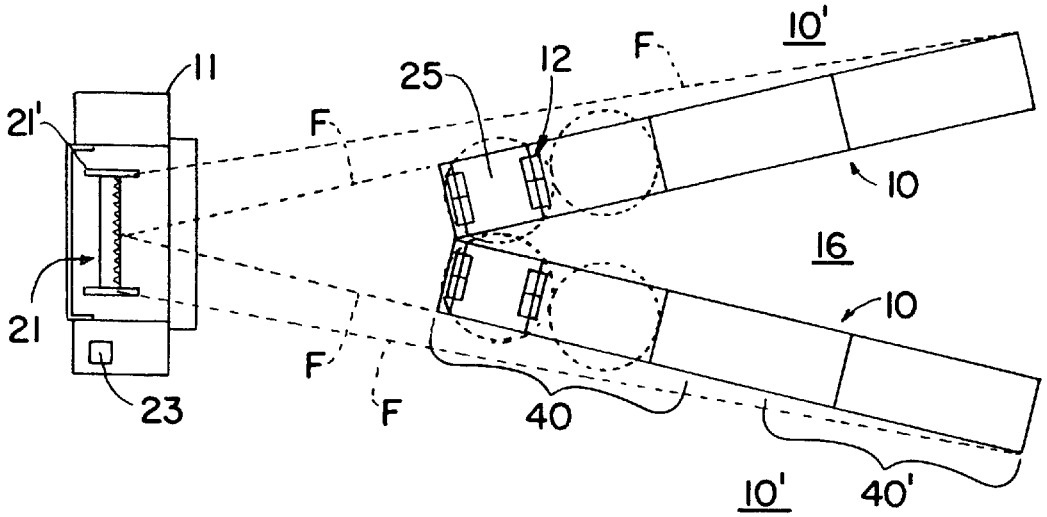
FIG. 2: a plan view of the arrangement of FIG. 1 in the direction A.

The bobbin creel 10 shown in FIGS. 1, 2 is a so-called V-creel, from two creel sides 10' of which threads F are fed to a winding device, namely a warper 11, by which the band of threads F are wound up on a winding shaft 21. The winding shaft 21 has winder plates 21' between which a pressure roll 22 presses against a coil of threads, which constantly becomes larger in diameter during winding. The winding process is controlled from a control panel 23 of the winding device, from where it can also be stopped if there is breakage of a thread F.

The bobbin creel 10 has a rather large number of creel fields 20 in which bobbins 24 are arranged in rows and columns in the usual way. To hold the bobbins 24 in each bobbin field 20, FIG. 2 shows schematically rotary creels 25, by dashed circles of rotation, which can be loaded from the inner space 16 of the bobbin creel 10, while the threads F are drawn off from the outside of the creel sides 10'.

Bobbin stations 12 with bobbin spindles on which the bobbins are set, not shown, hold the bobbins 24 in the bobbin creel. The thread F is drawn overhead off of these bobbins 24, then passes through a thread guide mechanism 13, cf. FIG. 4, and is diverted toward the winding device 11. So that all of the threads F of the entire band of threads F.F come to a stop arranged in the same way in case of a shutdown of the winding device 11. Each thread guide mechanism 13 has a thread clamp 14 that is attached to a creel strut 26. The creel strut 26 is part of the creel frame, not shown in detail, whose bobbin spindles also hold the bobbins 24. The creel strut 26 is open on the side so that a pipe-like housing 27 of the thread clamp 14 can be firmly installed at least partly into a hollow interior 28. This housing has an external retainer 29 which acts together with a clamp jaw 30 that is adjustable perpendicular to it in the plane of the drawing. The clamp jaw 30 is held by a pin 31 adjustable in the plane of the drawing and perpendicular to the creel strut 26 and to the housing 27, which is directed in the housing 27 in such a way that the clamp jaw 30 can move only according to this guiding mechanism. There is a clamp spring 32 that is supported on the one hand inside the housing 27 and on the other hand on the pin 31 so that it is retracted into the housing 27 if it is not controlled by a control wedge 33 that can press it into the open position shown in FIG. 4 when it is adjusted correspondingly perpendicular to the plane of the drawing. In this open position of the thread clamp 14, the clamp jaw 30 is so far removed from the retainer 29 that the thread F can pass through between the clamp jaw 30 and its retainer 29 without contacting the thread clamp 14. The thread F also has no contact with the pin 31 because it is located above it.

The thread F passes through the thread clamp 14 to a thread sensor needle 17 of the thread guide mechanism 13. The thread sensor needle 17 is fastened to the housing of the thread guide mechanism 13 by a pivot bearing, not shown.

The pivot bearing is located in a holder 36 that is integral with the housing 27. The thread sensor needle 17, besides sensing the thread, also diverts the thread F coming from the bobbin 24 to the winding device 11. In case of breakage of the thread F, the thread sensor needle 17 can pivot and send a signal about the broken thread.

Figure 4:
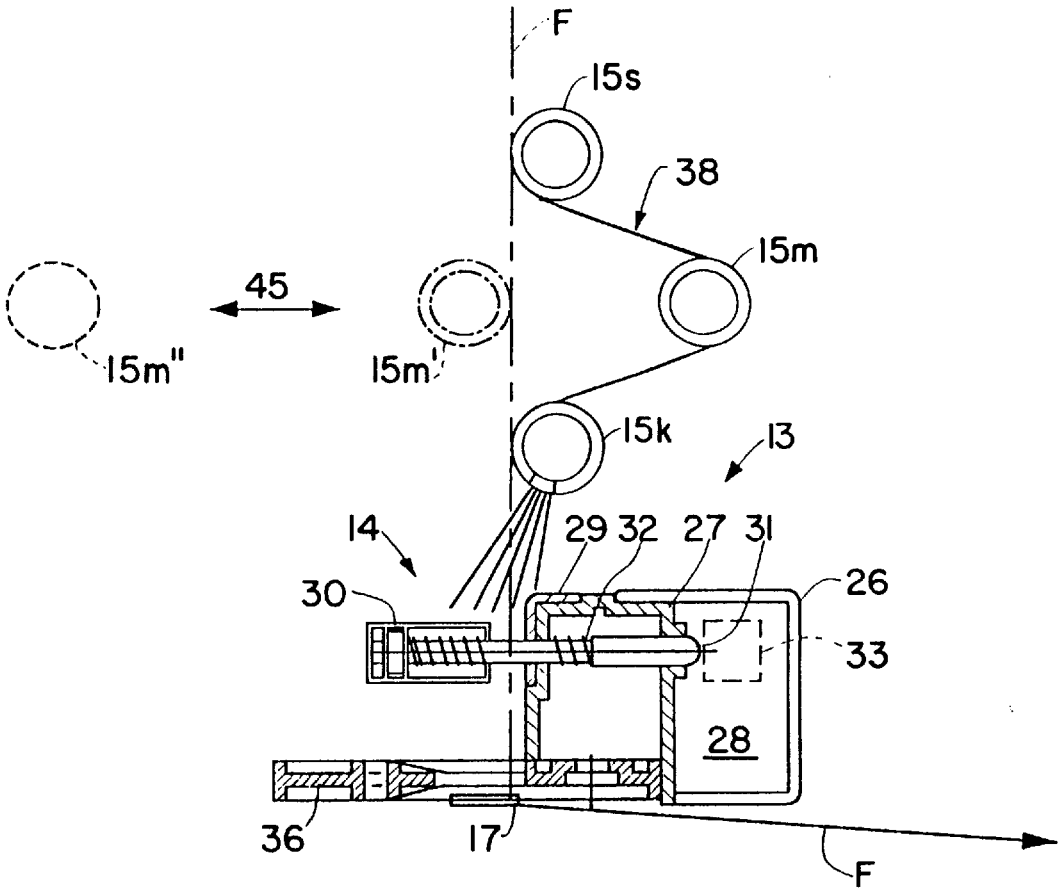
FIG. 4: a partially cutaway plan view in the region of a single bobbin station.

The thread F running off of a bobbin according to FIG. 4 passes through three pre-looping bars 15*s*, 15*m*, and 15*k*. All of the pre-looping bars are parallel to one another and arranged vertically. Therefore, they run parallel to the creel strut 26. The pre-looping bars 15*s*, 15*k* are fixed in position. The pre-looping bar 15*m* is adjustable in the directions 45. According to FIG. 4 it can be positioned so that the thread F forms a larger or smaller loop 38. The larger the loop, the greater is the looping of all of the pre-looping bars 15, which leads to a corresponding increase of the friction of the thread F, and thus to a corresponding increase of thread tension. The greatest possible reduction of the loop 38 can be achieved by adjusting the middle pre-looping bar 15*m* into the position 15*m*' shown in broken lines. There is then hardly any looping, but enough to hold the thread F on the bar 15*k* so that a contactless thread path remains in the area of the thread clamp 14.

The bars 15 are used in the bobbin creel 10 with various settings of their bar 15*m*. The position of the bar 15*m* shown in FIG. 4 is used in the area of bobbins 24 that are closest to the winding device 11, i.e. those for which the free-running thread length is the shortest and thus for which the effect of the surrounding air on the threads by atmospheric friction is the least. Threads F from the area of the end of the creel are drawn off with an arrangement of pre-looping bars 15 in which the middle bar assumes the position 15*m*', so that there is practically no effect of the bars 15 on the thread tension that develops in the thread F.

The bars 15*m* can be set so that the position 15*m*" is reached. It is then possible to change bobbins with no hindrance from the bars 15*m*. In this case the bars 15*s*, 15*k* are moved out of the position shown in FIG. 4 so that they do not hinder changing the bobbins. The positions of all of the bars 15 can be centrally controlled. It is therefore possible to move all of the bars 15 jointly.

Furthermore, the bars 15 are combined into functional groups 40, 40'. FIG. 2 indicates that for the side 10' of the creel 10 there are two successively positioned functional groups. Therefore, each comprises all of the bars 15 of the first three rotating fields 20 of FIG. 1.

All of the bars 15*m* of a functional group 40 or 40' are coupled at their ends with adjusting strips 46 and 46', which in turn can be impacted by stepping motors 47 and 47', respectively. It is possible, for example, by controlling the stepping motors 47, 47' differently, to adjust the bars 15*m* of the functional group 40 in the direction of the illustration of FIG. 4, while the bars 15*m* of the functional group 40' are guided to the position 15*m*'. As a consequence, the threads F of the first three fields 20 are given stronger tension than is to be allocated to the functional group 40. It is to be understood that the two sides 10' of the creel illustrated in FIG. 2 are subdivided in the same way into functional groups with regard to their bars 15.

Figure 3:
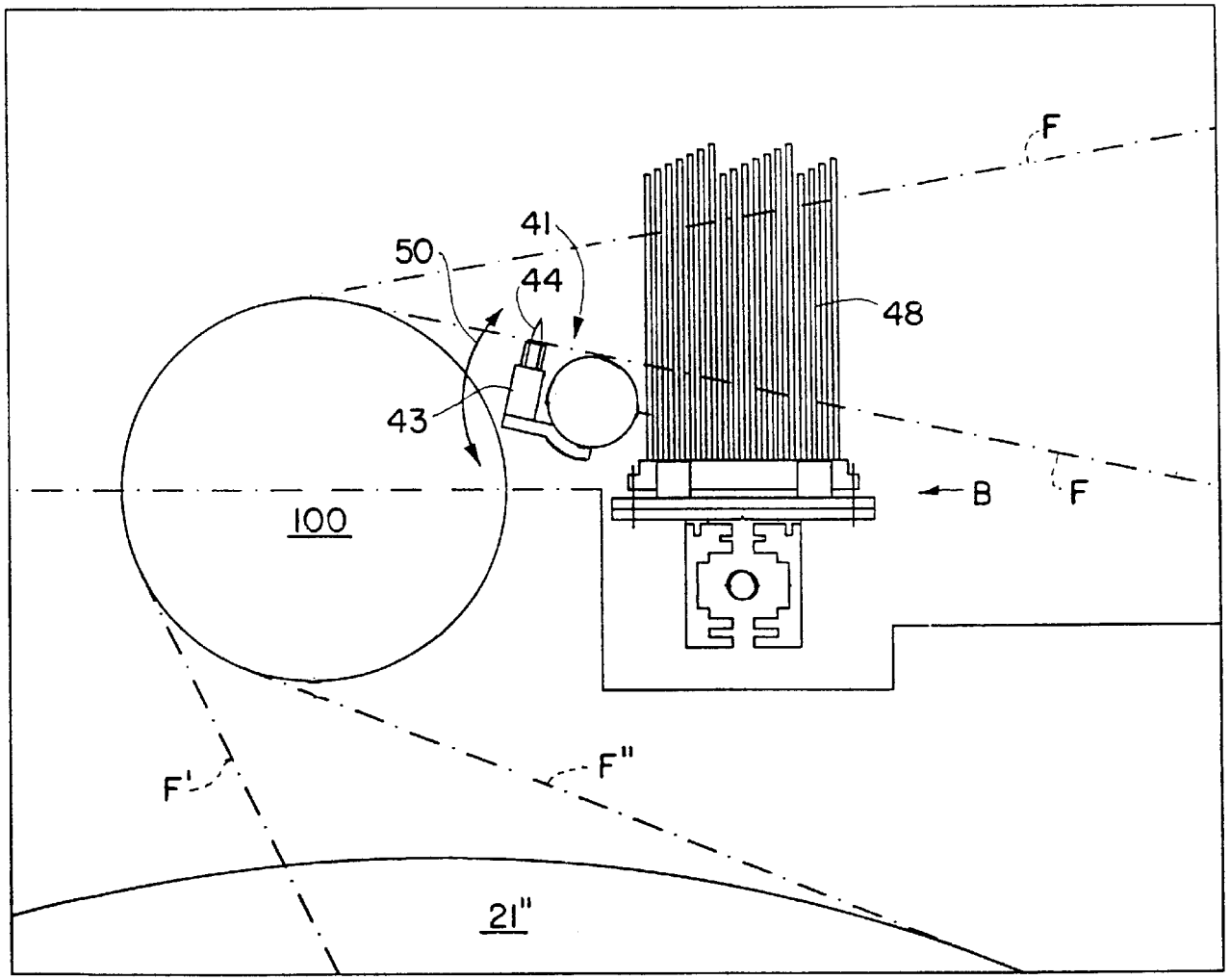
FIG. 3: an enlarged detailed view of portion x' of FIG. 1, namely an enlarged schematic illustration of the thread approach to a support roller of the winding device.
Figure 5:
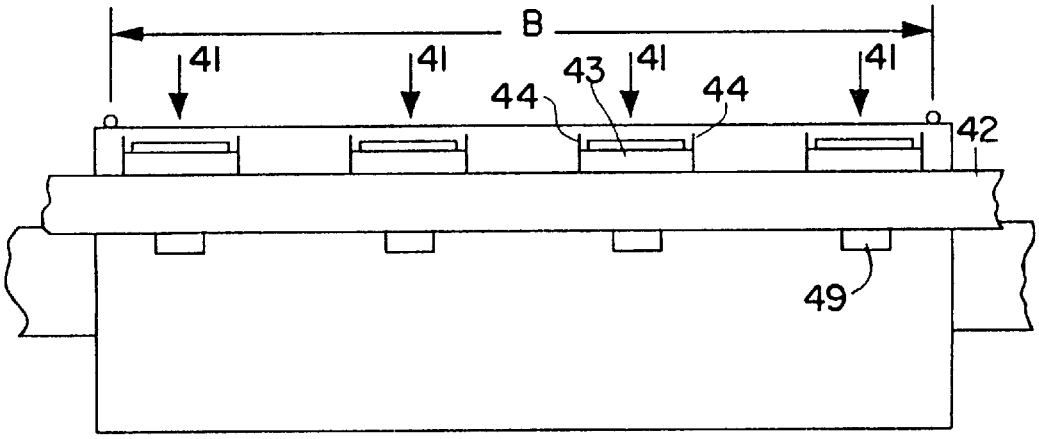
FIG. 5: a schematic illustration of the view B of FIG. 3.

To adjust the thread tensions of the threads F appropriately in the desired direction for different yam strengths, material surfaces, and/or speeds, the winding device 11 pursuant to FIGS. 3, 5 is equipped with measuring devices 41. The measuring devices 41 are distributed uniformly according to FIG. 5 along the breadth B of the winding shafts 21 and along the width B of the warp. This warp width B, for example, is the spacing determined by the winder plates 21'. All of the threads F of the entire band of threads are wound up on the shaft 21 distributed uniformly along this width B. To accomplish this they are fed in an orderly manner to the winding shaft 21. The ordered feed is accomplished first of all by comb 48, by which the threads F are kept in order over the width B. Accordingly, the threads F are fed in order over a support roller 100 to the coil 21" of the winding shaft 21. FIG. 3 shows the highest and lowest positions of the threads F according to FIG. 1 that run together over the support roller 100. The thread position F' issuing from it is set at the beginning of winding, where the threads F run directly onto the winding shaft, while the position F" is given by the coil 21" when the winding shaft 21 is almost completely full.

Between the comb 48 and the support roller 100 in the running direction of the threads, there is a thread-collecting bar 42. The band of threads of at least the threads F feeding in from the lowest bobbin stations of the creel 10 is brought to a new level by this thread-collecting bar 42, so that a number of threads of the whole band of threads run in parallel between the thread-collecting bar 42 and the support roller 100. In this area, the measuring devices 41 detect the thread tensions. The measuring devices 41 are fastened by retainers 49 to the thread-collecting bar 42 and have pressure-measuring strips 43 on which the threads F rest. The number of supported threads is obtained between dip blades 44, one of which in each case is located at each end of a pressure-measuring strip 43 and dips into the band of threads, as shown in FIG. 3. The pressure-measuring strip 43 is loaded by the threads F placed between two dip blades 44 and a corresponding measurement is taken from several threads F, which can be used to determine the thread tensions in the sense of averaging. The thread-collecting bar can be adjusted in the directions of the double arrow 50 to adapt to the measurement range of the measuring device 41, so that all of the pressure-measuring strips 43 with their dip blades 44 can be pivoted out of the thread area F and thus not hinder the threads from running free.

FIG. 5 shows that four measuring devices 41 are provided for the band of threads. Two measuring devices 41 are used for each of the two sides 10' of the V-shaped creel 10. A pair of measuring devices 41 is allocated to each functional group 40 or 40'. Therefore, the positions of all of the pre-looping bars 15*m* of one functional group 40 can be controlled by using the result of measurement by one measuring device 41, while the positions of the corresponding pre-looping bars 15*m* of the other functional group 40' are determined in accordance with the result of measurement by the other of the two measuring devices 41. The setting can be accomplished automatically. A control device, not shown, that evaluates the measurements from the measuring devices 41 and impacts the stepping motors 47 and/or 47' accordingly, serves this purpose. Such an adjustment is possible even during the winding operation.

The measuring device with its thread-collecting bar 42 can also be installed beneath the support roller 100. In this case the device automatically pivots in accordance with the increase of thickness of the coil 21".

What is claimed is:

1. Winding device for threads (F) from V-creels (10) having bobbins (24) from which the threads (F) are drawn via pre-looping bars (15) through a comb (48), and are wound up on a winding shaft (21) of the winding device, with the pre-looping bars (15) being wound with longer contact length of the threads near the winding device and less contact length of the threads at a distance from said winding device and with a degree of looping of the threads being centrally adjustable, with at least one measuring device (41) being located beyond the comb (48) in a running direction of the threads (F) for determining the thread tension in the threads (F), and with central adjustment of the pre-looping bars (15) being controllable according to the result of measurements by said measuring device, characterized by the fact that the pre-looping bars (15) of a side (10') of the creel (10) are subdivided into successively positioned functional groups (40, 40'), to one of which is allocated the measuring device (41) for determining thread tension in threads (F) of the one group, and wherein the central adjustment of the one group is controllable in accordance with the result of the measurement, and wherein all of said pre-looping bars of the one group are coupled at their respective ends with adjusting strips (46, 46'), each of the adjusting strips being acted upon by a stepping motor (47, 47') to effect the adjustment of the one group.

2. Winding device according to claim 1, characterized by the fact that the measuring device (41) is located in the running direction of the thread beyond a thread-collecting bar (42) tangential to threads (F) feeding in from the creel (10).

3. Winding device according to claim 2, characterized by the fact that the thread-collecting bar (42) is vertically adjustable and carries one or more of said measuring devices (41).

4. Winding device according to claim 1, characterized by the fact that the measuring device (41) is provided with a pressure-measuring strip (43) supporting a band of the threads (F), said strip having dip blades (44) at each end thereof that are adapted to dip into the band of threads.

5. Winding device according to claim 1, characterized by the fact that the measuring device (41) measures tension in at least some of the threads (F).

6. Winding device according to claim 5, characterized by the fact that the central adjustments are controllable to obtain at least one of equality of the results of measurement by all of the measuring devices (41) and predetermined thread tensions.

7. Winding device according to claim 1, characterized by the fact that all of the pre-looping bars (15) of one side (10') of the creel are subdivided into two of said functional groups (40, 40').

8. Winding device according to claim 1, characterized by the fact that only the group (40, 40') of pre-looping bars to which the measuring device (41) is allocated is centrally adjustable.

9. Winding device according to claim 1, characterized by the fact that a measuring device (41) is allocated to each functional group (40, 40').

10. Winding device for threads from V-creels having bobbins from which the threads are drawn via pre-looping bars, through a comb, and are wound up on a winding shaft of the winding device, with the pre-looping bars being wound with longer contact length of the threads near the winding device and less contact length of the threads at a distance from said winding device and with a degree of looping of the threads being centrally adjustable, with at least one measuring device being located beyond the comb in a running direction of the threads for determining the thread tension in the threads and with central adjustment of the pre-looping bars being controllable according to the result of measurements by said measuring device, wherein the pre-looping bars of at least one side of a creel are subdivided into successively positioned functional groups, to at least one of which is allocated the measuring device for determining thread tension in threads of this group, wherein the central adjustment of said at least one group is controllable in accordance with the result of the measurement, wherein the measuring device is located in the running direction of the thread beyond a thread-collecting bar tangential to threads feeding in from the creel, and wherein the thread-collecting bar is vertically adjustable and carries one or more of said measuring devices.

11. Winding device for threads from V-creels having bobbins from which the threads are drawn via pre-looping bars, through a comb, and are wound up on a winding shaft of the winding device, with the pre-looping bars being wound with longer contact length of the threads near the winding device and less contact length of the threads at a distance from said winding device and with a degree of looping of the threads being centrally adjustable, with at least one measuring device being located beyond the comb in a running direction of the threads for determining the thread tension in the threads, and with central adjustment of the pre-looping bars being controllable according to the result of measurements by said measuring device, wherein the pre-looping bars of at least one side of a creel are subdivided into successively positioned functional groups, to at least one of which is allocated the measuring device for determining thread tension in threads of this group, wherein the central adjustment of said at least one group is controllable in accordance with the result of the measurement, wherein the measuring device is provided with a pressure-measuring strip supporting a band of the threads, said strip having dip blades at each end thereof that are adapted to dip into the band of threads.

* * * * *